US009075425B2

(12) United States Patent
Burrell et al.

(10) Patent No.: US 9,075,425 B2
(45) Date of Patent: Jul. 7, 2015

(54) ADJUSTABLE OUTPUT POWER SUPPLY

(71) Applicant: Research In Motion Limited, Waterloo (CA)

(72) Inventors: Douglas James Arthur Burrell, Waterloo (CA); Jason Tyler Griffin, Kitchener (CA); Todd Andrew Wood, Toronto (CA)

(73) Assignee: BlackBerry Limited, Waterloo, Ontario (CA)

( * ) Notice: Subject to any disclaimer, the term of this patent is extended or adjusted under 35 U.S.C. 154(b) by 126 days.

(21) Appl. No.: 13/866,442

(22) Filed: Apr. 19, 2013

(65) Prior Publication Data

US 2014/0312856 A1 Oct. 23, 2014

(51) Int. Cl.
*G05F 1/66* (2006.01)
*H05B 33/08* (2006.01)

(52) U.S. Cl.
CPC ..... *G05F 1/66* (2013.01); *H05B 33/0848* (2013.01)

(58) Field of Classification Search
CPC ..... H05B 33/0848; H02M 2001/0009; H02M 7/53871
See application file for complete search history.

(56) References Cited

U.S. PATENT DOCUMENTS

| | | | | |
|---|---|---|---|---|
| 5,164,652 | A | 11/1992 | Johnson et al. | |
| 5,821,734 | A | 10/1998 | Faulk | |
| 6,091,611 | A | 7/2000 | Lanni | |
| 6,650,560 | B2 | 11/2003 | MacDonald et al. | |
| 7,377,805 | B2 | 5/2008 | Kim et al. | |
| 7,727,005 | B2 | 6/2010 | Lanni | |
| 7,840,740 | B2 | 11/2010 | Minoo | |
| 7,884,571 | B2 | 2/2011 | Veselic | |
| 8,212,388 | B2 | 7/2012 | Langgood et al. | |
| 8,290,171 | B1 | 10/2012 | Helfrich et al. | |
| 8,330,422 | B2 | 12/2012 | Bayne et al. | |
| 2005/0134321 | A1 | 6/2005 | Ede | |
| 2007/0279954 | A1* | 12/2007 | Garrett et al. | 363/91 |
| 2008/0303486 | A1 | 12/2008 | Kao et al. | |
| 2008/0315830 | A1* | 12/2008 | Bertness | 320/104 |
| 2009/0096294 | A1 | 4/2009 | Youn et al. | |
| 2012/0245514 | A1* | 9/2012 | Joglekar | 604/67 |
| 2013/0002195 | A1 | 1/2013 | Lee et al. | |

FOREIGN PATENT DOCUMENTS

| | | |
|---|---|---|
| EP | 1691252 | 8/2006 |
| WO | 2005/057782 | 6/2005 |
| WO | 2010108551 | 9/2010 |

OTHER PUBLICATIONS

European Search Report dated Oct. 17, 2013 for European Application No. 13164571.

* cited by examiner

*Primary Examiner* — Hyun Nam
(74) *Attorney, Agent, or Firm* — Jeffrey N. Giunta; Fleit Gibbons Gutman Bongini & Bianco P.L.

(57) ABSTRACT

An adjustable output power supply with a data communications connector that at least partially complies with physical specifications of a defined data interface standard connector, such as a USB connector. The data communications connector has a number of data contacts and power contacts coupled to and providing output electrical power from a programmable power supply. A controller receives an indication of a detection of a feature of a mating connector coupled to the data communications connector, determines, based on receiving the detection, at least one resistance value between a data contact and at least one power contact, and adjusts an output voltage of the programmable power supply based on the at least one resistance value.

20 Claims, 7 Drawing Sheets

ADJUSTABLE OUTPUT POWER SUPPLY

FIELD OF THE DISCLOSURE

The present disclosure generally relates to systems and methods associated with electrical device power supplies, and more particularly to adapting such power supplies to the electrical power output characteristics of different electrical devices.

BACKGROUND

Many electrical devices receive electrical power through power adapters that convert electrical power available to the device, such as the "mains" power that is often provided by local utility companies in the form of 110 Volt/220 Volt AC electrical power, into the voltage levels used by the particular electrical device. For example, laptop computers and other electrical device often use an external power supply that plugs into a wall socket to obtain electrical power and provides an electrical power output at a voltage and with an output electrical current limit that is suitable for the electrical device. Common output voltages for laptop computers include 12 Volts, 19 Volts, and other voltages depending on the design of the laptop computer. Such devices also have external power supplies that are able to provide output electrical current of several amperes at the specified output voltage. Such external power supplies are able to have a limited output electrical current where the maximum output electrical current produced by the external power supply is limited to a specified output electrical current limit value based upon the design of the device receiving the output power in order to, for example, protect against a component failure or short circuit in the device receiving the output power from the external power supply.

In another example, many electrical devices include a data communications connector that also allows electrical power to be provided to the device. One example of such a data interface connector is a Universal Serial Bus (USB) connector, such as a USB socket connector defined according to the Universal Serial Bus (USB) standard as defined by the USB Implementers Forum, Inc. It has become common for many electrical devices to utilize a socket connector as defined by the USB standard as an interface over which to receive electrical power for operations of components of the electrical device, to charge a battery or other power pack in the device, or for both. The USB standard specifies that socket connectors are to provide electrical power at five (5) Volts with a maximum current of up to 500 mA.

The various electrical power requirements of different electrical devices generally requires a person with many electrical devices to keep a number of power supplies with one power supply that is configured to provide electrical power with the voltage and electrical current required by each different electrical device. Although some power supplies are available that allow changing the output power voltage characteristics to accommodate different devices, such power supplies require specialized connectors to adapt the power supply output to the electrical device that is to receive the electrical power.

Power supplies will benefit from techniques that allow conventional power supply output ports to be reused as power output ports to provide output electrical power at various output voltages and with various output electrical current limits.

BRIEF DESCRIPTION OF THE DRAWINGS

The accompanying figures, where like reference numerals refer to identical or functionally similar elements throughout the separate views, and which together with the detailed description below are incorporated in and form part of the specification, serve to further illustrate various embodiments and to explain various principles and advantages all in accordance with the present disclosure, in which.

DETAILED DESCRIPTION

Figure 1:
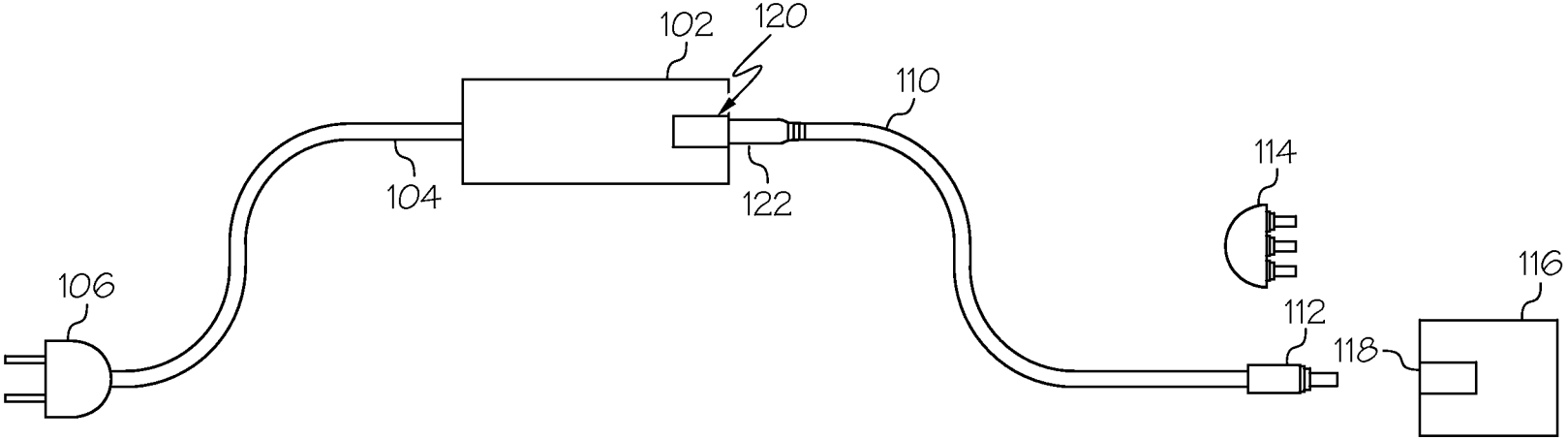
FIG. 1 illustrates an adjustable output power supply layout, according to an example.

As required, detailed embodiments are disclosed herein; however, it is to be understood that the disclosed embodiments are merely examples and that the systems and methods described below can be embodied in various forms. Therefore, specific structural and functional details disclosed herein are not to be interpreted as limiting, but merely as a basis for the claims and as a representative basis for teaching one skilled in the art to variously employ the present subject matter in virtually any appropriately detailed structure and function. Further, the terms and phrases used herein are not intended to be limiting, but rather, to provide an understandable description of the concepts.

The terms "a" or "an", as used herein, are defined as one or more than one. The term plurality, as used herein, is defined as two or more than two. The term another, as used herein, is defined as at least a second or more. The terms "including" and "having," as used herein, are defined as comprising (i.e., open language). According to context, the term "coupled," as used herein, is generally defined as "connected," although not necessarily directly, and not necessarily mechanically. In the case of inductive coupling, there may be no physical connection between components, as inductive coupling between two coils can occur when a current in one induces a current in the other even if the coils are separated. In the case of electric coupling, the connection may form part of a current path. Components that are "communicatively coupled" are configured to communicate (that is, they are capable of communicating) in any fashion for any duration, such as by way of electric signals, optical signals, wireless signals, or any combination thereof. Communicatively coupled components are able to be directly connected to one another, connected through any combination of intermediate physical components or other elements that support communications between the communicatively coupled components, connected at least in part by one or more electromagnetic, optical or similar communications medium, by one or more other coupling components, or by combinations of these. The terms "configured to" and "adapted to" describe hardware, software or a combination of hardware and software that is (according to context) capable of, set up, arranged, built, composed, constructed, designed, able to accommodate or make, suitable to carry out or that has any combination of these characteristics to carry out a given function. In the following discussion, "handheld" is used to describe items, such as "handheld devices," that are sized, designed and otherwise configured to be carried and operated while being held in a human hand. The term "value," according to context, may refer to a numerical value or a magnitude or a threshold or an amplitude or any other quality of a thing or characteristic, such as electrical voltage between two points, that may have a range of qualities.

The below described systems and methods associated with adjustable output power supplies. An adjustable output power supply has an output connector that at least partially complies with physical specifications of a defined data interface standard connector, such as a Type A Socket USB connector. The output connector provides output power from the adjustable output power supply to devices that connect to the output connector. Complying with the physical specifications, colloquially speaking, refers to the elements being able to fit and function together. Complying with the physical specifications may also be called conforming to the physical specifications. In this context, a connector that at least partially conforms to the physical specifications of a defined data interface standard connector refers to a connector with physical characteristics that allow physical coupling with a complementary connector for the defined data interface standard connector. The output connector allows coupling of a mating connector that fully complies with a corresponding connector for the defined data interface standard connector, such as a conventional Type A plug USB connector. The output connector also allows insertion of a mating connector that has a feature, such as a physical key, that allows detection of the feature by a sensor within the power supply. In the absence of a detection of the feature, the power supply provides electrical power specified for the defined data interface standard connector through the output connector (e.g., 5 Volts with an electrical current limit of 500 mA in the case of a Type A socket USB connector). When the presence of the feature of a mating connector is detected, the power supply provides electrical power through the output connector based upon resistance values present between electrical data contacts of the output connector and the power supply contacts of the output connector. Different cables with a connector having the feature to couple to the power supply, or different cable connector ends that attach to a cable with a connector having the feature to couple to the power supply, are able to be associated with each different electrical device that is to receive power from the power supply. Each of these different cables or cable connectors are able to have different resistance values coupling one or more data contacts of the output connector to respective electrical power connectors of the output connector in order to cause the adjustable output power supply to deliver electrical power with the correct output voltage and output electrical current limit value. An adjustable output power supply may include, but does not necessarily include, a power source such as a battery, fuel cell, or other electrical power storage or generation component. In some embodiments, the adjustable output power supply transmits or conveys electrical power that is obtained from a power source (such as an external power pack or a wall socket) to an electrical device.

The below described examples provide an adjustable output power supply that is able to be used with conventional data communications connectors, such as USB connectors, to deliver electrical power to the many electrical devices that are configure to receive power through such a conventional data connector. This adjustable output power supply is further able to be used to provide electrical power to other electronic devices that receive electrical power with different characteristics. For example, such a power supply is able to be used to provide power to conventional portable electronic devices through a USB connection, and also provide electrical power to a portable computer at higher voltage and with higher output electrical current limit values in order to more rapidly recharge power packs in, or to properly support operations of, the portable computer.

FIG. 1 illustrates an adjustable output power supply layout 100, according to an example. The illustrated adjustable output power supply layout 100 includes an adjustable output power supply 102 provides output electrical power through an output connector 120 to electrical device, such as electrical device 116, according to various conditions. As described below, the adjustable output power supply 102 is a data communications connector that at least partially complies with physical specifications of a defined data interfaced standard, where the data communications connector is also able to provide output electrical power with characteristics that conform to either the defined data communications standard or that conform to requirements indicated by components connected to the output connector 120 of the adjustable output power supply 102.

The adjustable output power supply 102 receives input power through an input cable 104. In the illustrated example, the input cable has an input plug 106 that connects to an electrical power source (not shown). The input power is able to be provided through the input plug 106 in any suitable form, such as conventional mains electrical power produced by a local utility that is delivered as Alternating Current (AC) with a line voltage that is generally between 100 and 240 volts according to local customs. Alternatively, the input power is able to be provided as a Direct Current (DC) electrical power at an available voltage, such as 12 Volts, 24 Volts, or any other available voltage. In some examples, the adjustable output power supply 102 is able to automatically detect the parameters of the received input power, such as the voltage level present and whether it is an alternating or direct current power source, and automatically adjust the power supply configuration to operate with input power having those detected characteristics. In some examples, the adjustable output power supply 102 allows manual selection or other specification of various input power characteristics, such as the voltage level and whether it is an alternating current or direct current electrical power source. The input power characteristics are able to be selected or specified by, for example, a manually operated switch, a keyed or otherwise configured identifying connector used to connect the input cable 104 to the power supply 102, any suitable selection techniques, or combinations of these.

The illustrated adjustable output power supply 102 provides output electrical power through at least one output connector 120. In one example, the output connector 120 has physical characteristics that at least partially comply with the physical specifications of a defined data interface standard connector. In the example described below, output connector 120 is a data communications connector that at least partially conforms to the physical specifications of a defined data interface standard connector where the defined data interface standard connector is a Type A socket USB connector as defined by the Universal Serial Bus (USB) standard, as issued by the USB Implementers Forum, Inc. In general, a particular defined data interface standard connector is defined by a specification set that further defines a complementary connector that is designed to be coupled to the particular defined data interface standard connector. In the following discussion, the term "complementary connector" refers to the complementary connector defined by the interface connector standard that is designed to couple to the defined data interface standard connector. In the context of the example discussed below, where the defined data interface standard connector is a Type A socket USB connector, a mating connector is a Type A plug USB connector.

The output connector 120 in one example has physical dimensions and other characteristics that at least partially conform to the physical specifications for a Universal Serial Bus (USB) Type A socket. In this context, a connector that at least partially conforms to the physical specifications of a defined data interface standard connector refers to a connector with physical characteristics that allow physical coupling with a complementary connector for the defined data interface standard connector. In the below described example, the output connector 120 at least partially conforms to the physical specifications for the Type A socket USB connector, and therefore allows connection with a conventional Type A plug USB connector. As discussed below, the output connector 120 differs from the physical specifications for the Type A socket USB connector so as to allow a mating connector with a "feature," where the feature causes the mating connector differs from the physical specifications of the Type A plug USB connector.

The output connector 120 of the adjustable output power supply 102 receives a mating connector 122. In the context of the following discussion, the term "mating connector" refers to a connector that is coupled to, such as by insertion or any other technique, the output connector 120. The term "mating connector" in this context refers to a connector that either conforms to the physical specifications for a complementary connector of the defined data interface standard connector, or to a connector that differs from such physical specifications by the presence of a feature in proximity to the mating connector, as is described below.

The mating connector 122 is conductively coupled to an output power cable 110 that conveys at least electrical power to a device adapter 112. The device adapter 112 is configured to be able to be inserted into a power input socket 118 of an electrical device 116. Once the device adapter 112 is inserted into the power input socket 118, the adjustable output power supply 102 is electrically coupled to electrical device 116 in this example by the output power cable 110 via contacts within the mating connector 122 and the device adapter 112.

In one example, the device adapter 112 is detachably connected to the output power cable 110 and another device adapter, such as the illustrated second device adapter 114, is able to be connected to the output power cable 110. The second device adapter 114 is able to be properly received in a power input socket (not shown) of another electronic device (not shown). As described below, the apparatus connected to the output connector 120 is able to include resistive elements that couple one or more data contacts within the output connector 120 to power contacts also within the output connector 120. The values of such resistive elements are measured or otherwise determined by components within the adjustable output power supply 102 in response to detection of a feature of the mating connector 122.

In one example, the mating connector 122 at least partially conforms to the specifications for the Type A plug USB connector. The mating connector 122 differs from the physical specifications for the Type A plug USB connector by the presence of a feature that causes the mating connector 122 to differ from the specifications for the Type A plug. The feature of the mating connector is able to be a physical feature or other type of feature, such as one or more magnets placed within or proximate to the mating connector 122. In this context, a feature is in proximity to, or is placed proximate to, the mating connector 122 when it is located in a position relative to the mating connector 122 such that a feature sensor within the adjustable output power supply 102 is able to sense or detect that feature. In one example, the feature of the mating connector 122 is proximate to the mating connector 122 by being attached to a physical component of the mating connector, where that physical component is defined for the complementary connector of the defined data interface standard connector.

In this example, the output connector 120 at least partially conforms to a defined data interface standard connector, which is a Type A socket USB connector, that includes both data communications circuits and electrical power circuits. In the case of coupling to a mating connector 122 that fully conforms to the physical specifications for a Type A plug USB connector, the output connector 120 is able to be configured to operate in conformance with the other aspects, such as the electrical aspects, that are defined for the Type A socket USB connector. For example, when the output connector 120 receives a mating connector 122 that fully conforms to the specifications for a Type A plug USB connector, components within the adjustable output power supply 102 are able to communicate data through data circuits present in the output connector 120 according to the operations defined by the relevant data interface standard, such as the USB standard. Further, the power supply is able to, when receiving a mating connector 122 that fully conforms to the specifications for a USB Type A plug, to form connections to or between data line connections of the output connector 120 to indicate the presence of a power supply driving the output connector 120. For example, shorting together the data lines of a USB connector used as a power supply output is a common indicator that an electrical device coupled to such a connector is connected to a power supply and not a device that supports data communications.

Although the above description and FIG. 1 illustrates an adjustable output power supply 102 that contained in a separate enclosure, it is clear that a similar adjustable output power supply is able to be included or incorporated as part of another apparatus, such as an electronic device, power generator, other device, or combinations of these. In examples that include a power supply as part of another device, the power supply is able to receive input power through an input cable, similar to the input cable 104, which is connected directly to the power supply, or the power supply is able to receive input power from components of the device into which the power supply is included, such as from power packs, external power connectors, other sources, or combinations of these.

Figure 2:
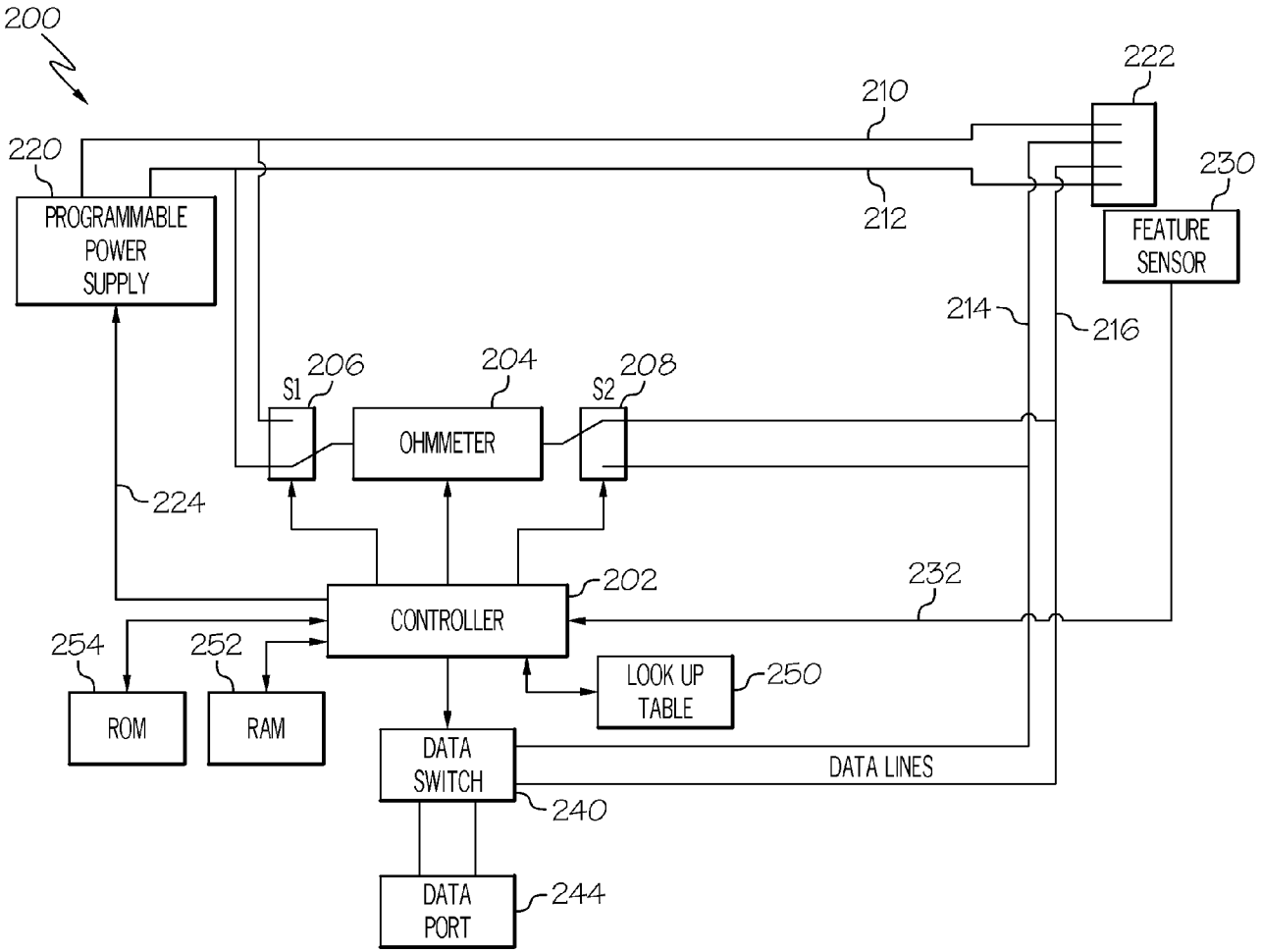
FIG. 2 illustrates a power supply circuit diagram, in accordance with one example.

FIG. 2 illustrates a power supply circuit diagram 200, in accordance with one example. The power supply circuit diagram 200 illustrates an example of electrical circuits contained within an adjustable output power supply, such as the above described adjustable output power supply 102. The power supply circuit diagram 200 depicts components and interconnections between those components that allow the adjustable output power supply 102 to determine an output voltage value and an output electrical current limit value to use when providing (that is, supplying) output power through the output connector 120. Components of the power supply circuit diagram 200 further configure a programmable power supply to output voltage at the determined output voltage and to limit output electrical current to the determined output electrical current limit value.

The components depicted in the power supply circuit diagram 200 operate to deliver electrical power through an output connector 222. The above described output connector 120 is an example of the output connector 222. The output connector 222 is a data communications connector that at least partially complies with physical specifications of a defined data interface standard connector, such as the Type A USB socket connector discussed above.

The power supply circuit diagram 200 includes a programmable power supply 220 that is able to be configured to output electrical power at various output voltages. The programmable power supply 220 is also able to be configured to produce a settable limited output electrical current such that the output electrical current is limited to a maximum amount that corresponds to an output electrical current limit value. The programmable power supply 220 outputs Direct Current (DC) power in this example on a positive output power line 210 and a negative output power line 212. These two output power lines couple the programmable power supply 220 to power interface contacts within an output connector 222. In the context of this description, the term output electrical current limit value refers to a value defining a maximum electrical current limit at which output power is able to be delivered by the programmable power supply 220. In one example, the programmable power supply will provide output electrical power at a specified output voltage as long as the electrical current drawn from the programmable power supply 220 is below the specified output electrical current limit value. When electrical current drawn from the programmable power supply 220 exceeds the specified output electrical current limit value, the programmable power supply 220 is able to discontinue delivering electrical power or reduce the output voltage of the delivered electrical power. A programmable power supply 220 configured to operate with an output electrical current limit value is referred to as providing output electrical power with a limited output electrical current.

The power supply circuit diagram 200 depicts a controller 202 that performs various processes to control the operation of the components depicted in the power supply circuit diagram 200. The controller 202 is communicatively coupled to, and provides (i.e., generates, conveys or otherwise supplies) control signals 224 to, the programmable power supply 220. The control signals 224 specify, for example, the output voltage value and the output electrical current limit value to be used by the programmable power supply 220 when providing output electrical power through the output connector 222. As is described below, the controller 202 controls and exchanges data with some components depicted in the power supply circuit diagram 200 and performs processing to determine the values of the output voltage and output electrical current limit that are to be set for the programmable power supply 220.

The controller 202 in this example is in communications with Random Access Memory (RAM) 252 and Read Only Memory (ROM) 254 and is able to exchange program code with these memory devices. In one example, Read Only Memory 254 stores program code that is executed by controller 202 to perform the processing described below with regards to configuring the programmable power supply 220, responding to a sensed feature of a connector, determining resistance, and other functions. Data determined or otherwise obtained by processing performed by the controller, including receipt of data from external sources, is able to be stored in the Random Access memory 252 in order to, for example, support processing performed by the controller 202.

The output connector 222 is an example of the output connector 120 described above with regards to FIG. 1. The output connector 222 in this example conforms to the physical characteristics specified for a Type A socket as defined by the USB standard. The output connector 120 has two electrical power contacts that are specified for the Type A socket USB connector to convey electrical power through the connector, and also has at least two data contacts that are also specified for the Type A socket USB connector to convey data through the connector. The two electrical power contacts of the output connector 222 are respectively coupled to the positive output power line 210 and the negative output power line 212. The output connector 222 therefore is coupled to and provides output power from the programmable power supply 220. The two data contacts of the output connector 222 are respectively coupled to a first data line 214 and a second data line 216 for electrical connections to other components as is described below.

The power supply circuit diagram 200 includes a feature sensor 230. The feature sensor 230 in this example is located in physical proximity to the output connector 222. In the context of the following description, a feature sensor 230 is located in proximity to the output connector 222 when the feature sensor 230 is able to detect the particular feature of the mating connector. In various examples, the mating connector is able to have different features located at different positions relative to the mating connector body, which results in the feature being located at correspondingly different locations when the mating connector is coupled to the output connector 222. The feature sensor 230 is communicatively coupled to the controller 202 and operates to detect a presence of a feature of a mating connector that is coupled to the output connector 222 and provides (i.e., generates, conveys or otherwise supplies) to the controller 202, through sensor interface 232, an indication of the detection of the feature of the mating connector coupled to the output connector 222. The features whose presence is detected by the feature sensor 230 are generally a feature of a mating connector coupled to, such as being inserted into, the output connector 222 where the feature causes to mating connector to differ from the physical specifications for a complementary connector for the defined data interface standard connector whose physical specifications the output connector 222 at least partially complies. In the presently discussed example, the output connector 222 at least partially conforms to the physical specifications for a Type A socket USB connector, and the feature sensor 230 detects a feature of a mating connector that causes the mating connector to differ from the physical specifications for a Type A plug USB connector. In general, the feature sensor 230 detects a presence of a particular feature, such as a particular physical protrusion, a magnetic component within the mating connector, another type of particular feature, or combinations of these.

In one example, the feature sensor 230 is able to include a mechanical switch that is positioned with respect to the output connector 222 so as to detect the presence of a physical feature of the mating connector when a mating connector is mated inserted into the output connector 222. For example, a mechanical switch included in a feature sensor 230 is able to be positioned so that a particular physical feature, such as a protrusion, of a mating connector presses an actuator of the mechanical switch and changes a state of contacts within the switch. The state of such contacts, and the change in their state due to the detection of the physical feature, is provided to the controller 202 via a sensor interface 232. In one example, the state of the contacts can be provided to the controller 202 in the form of an electrical signal that is flows through the feature sensor 230 due to contact closure (i.e., completing an electrical circuit through the mechanical switch of the feature sensor 230 by pressing contacts of the mechanical switch together by the presence of the physical feature). In further examples, a feature sensor 230 is able to perform any sensing technique to detect a feature of a mating connector. For example, a feature sensor 230 is able to include an optical sensor to determine the physical presence of an optically observable feature of a mating connector, a magnetic sensor to determine the presence of a magnet that is present in a mating connector, any other type of sensor, or combinations of these. The feature sensor 230 in this example is coupled to the controller 202 through the sensor interface 232 to provide to the controller 202 an indication of the detection of a feature on a mating connector that is coupled to, such as by being inserted into, the output connector 222.

In one example, the controller 202 responds to an absence of a detection of a presence of a feature of the mating connector by adjusting the output voltage of the programmable power supply 220 to correspond to an output power voltage specified for the defined data interface standard connector whose physical specifications the output connector 222 at least partially complies. In the above described example, the output connector 222 at least partially complies with the physical specifications for a Type A socket USB connector. In this example, when a mating connector without a feature, such as a conventional Type A plug USB connector, is coupled to the output connector 222, the controller 202 adjusts the programmable power supply 220 to produce electrical power that conforms to the electrical specifications defined for a conventional Type A socket USB connector. A conventional Type A plug USB connector that is inserted into the output connector 222 would result in no feature being detected by the feature sensor 230, and therefore no indication of a detection of the presence of the feature is provided to the controller 202, thereby resulting in an absence of the detection of the presence of the feature. In that example, the electrical power provided through the output connector 222 has an output value of five volts and an output electrical current limit value of 500 mA across the positive output power line 210 and the negative output power line 212, which is the output power voltage and output electrical current limit value defined for a Type A socket USB connector. In a similar example, the programmable power supply is adjusted to provide an output voltage of five (5) volts in the absence of an indication of the detection of the feature but a higher output electrical current limit to provide increased electrical power to a device connected to the output connector 222. In further examples, the output connector 222 complies with physical specifications of other connectors defined by other defined data interface standards, such as the IEEE 1394 standard (also known as FireWire), and the programmable power supply 220 is configured to provide electrical power as specified by that defined data interface standard.

In one example, an apparatus connected through a mating connector that is connected through the output connector 222 is able to control the output voltage value and the output electrical current limit value by placing defined resistance values between one or both of the data lines coupled through the output connector 222 and one or both of the power lines coupled through the output connector. In one example, such an apparatus couples to the output connector 222 with a mating connector that has a feature whose presence is detected by the feature sensor 230. In one example, the controller 202 responds to receiving an indication of a detection of a presence of the feature by the feature sensor 230 by determining at least one resistance value between one or more of the data contacts and one or more electrical power contacts, where the one or more data contacts and the one or more electrical power contacts couple through the output connector 222. In one example, the controller 202 determines these resistance values by measuring the value of electrical resistances between these connectors, as is described below. The controller 202 then determines the values of output voltage and output electrical current limit with which to configure the programmable power supply 220 based upon those measured resistance values, and proceeds to adjust the output voltage of the programmable power supply 220 to produce the output voltage and output electrical current limits that correspond to those measured resistances.

In the illustrated example, the power supply circuit diagram 200 depicts an ohmmeter 204 with a first port connected to a first switch 206 and a second port connected to a second switch 208. The ohmmeter 204 operates to determine the electrical resistance value of conductive resistance that is present between its first port and its second port. As is described below, cables or other equipment connected to the output connector 222 are able to have electrically resistive elements coupling one or of the data lines connected through the output connector 222 to one or more power lines coupled through the output connector 222. In one example, the controller responds to an indication received from the feature sensor 230 of a detection of the presence of a feature on an inserted mating connector by configuring the first switch 206 and the second switch 208 to allow the ohmmeter 204 to measure these resistance values. The controller 202 exchanges data with the ohmmeter 204 to receive the measured values for these resistances, and determines an output voltage and an output electrical current limit value based on those measured resistance values. The controller 202 then adjusts the output voltage and the output electrical current limit of the programmable power supply 220 by configuring the programmable power supply 220, through control signals 224, to output electrical power with the determined output voltage level and output electrical current limit.

In one example, a first resistance value is measured for a measured resistance level between the positive output power line 210 and the first data line 214. The controller 202 obtains this first resistance value by configuring the first switch 206 to connect the positive output power line 210 to the first port of the ohmmeter 204 and by configuring the second switch 208 to connect the first data line 214 to the second port of the ohmmeter 204. The controller 202 then receives from the ohmmeter 204 a measured resistance value for the first resistance value. A second resistance value is then measured for the resistance between the negative output power line 212 and the second data line 216. The controller obtains the second resistance value by configuring the first switch 206 to connect the negative output power line 212 to the first port of the ohmmeter 204 and configuring the second switch to connect the second data line 216 to the second port of the ohmmeter 204. The controller then receives from the ohmmeter 204 a measured resistance value for the second resistance value. The controller 202 in this example then determines an output voltage to be provided across the positive output power line 210 and the negative output power line 212, which is the output voltage provided through the output connector 222, based upon the measured first resistance value and the second resistance value received from the ohmmeter 204.

In one example, values for the output voltage and output electrical current limit are obtained in conjunction with the use of a look-up table 250 that stores a corresponding value for output voltage, output electrical current limit, or both, for each measured resistance value or range of resistance values. The determination of the output voltage based upon the first resistance value in such an example is based upon retrieving from the look-up table 250, based upon the first resistance value, the output voltage value that is stored in association with the first resistance value. The determination of the output electrical current limit is based upon retrieving from the look-up table 250, based on the second resistance value, the output electrical current limit value that is stored in association with the second resistance value. In further examples, any technique is able to be used to map the measured resistances and the values of output voltage and output electrical current limit, such as a mathematical equation or other suitable technique that determines one or more output values for these parameters based upon the measured resistance values. The output voltage and output electrical current limit that are determined by the controller 202 in this example is provided as control signals 224 to the programmable power supply 220, which produces output electrical power with those characteristics through the output connector 222 across contacts coupled to the positive output power line 210 and the negative output power line 212.

The power supply circuit diagram 200 in this example includes a data port 244 through which data is coupled with the output connector 222 through the first data line 214 and the second data line 216. Data port 244 in one example is able to be another data port that is available on the outside of a power supply to which another electronic device is able to connect to exchange data with a device connected to the output connector 222. In another example, the data port is able to be a connection with any type of data equipment, such as a processor or other device, that is within or outside of the housing containing the components of the power supply circuit diagram 200. In alternative examples, the data lines, such as the first data line 214 and the second data line 216 are used to exchange data through the output connector 222 and do not have a data port 244 or other connections to the data lines apart from connections to determine the resistance between one or both data lines and one or both power lines as is described above.

The power supply circuit diagram 200 further includes a data switch 240. The data switch 240 is configured in one example, by the controller 202 based upon receiving the detection of a presence of a feature on a mating connector, to disable data communications over the data lines coupled through connectors of the output connector 222. The data switch 240 in one example disconnects the first data line 214 and the second data line 216 from data contacts of the data port 244. In one example, the controller 202 configures the data switch to disconnect data couplings between the output connector 222 and the data port 244 when an indication of a detection of a feature on a mating connector is received from the feature sensor 230. In one example, the data lines are disconnected due to the alternative use of these data lines in the device connected to the output connector 222, such as the coupling of resistive elements between one or more data lines and the power supply lines as is described above. When a feature is not detected by the feature sensor 230, a mating connector that conforms with the specifications of the defined data interface standard is able to be inserted into the output connector 222, and data communications are able to be performed through the connector. In another example, the controller 202 configures data switch 240 when no feature is detected to connect the first data line 214 and the second data line 216 in a manner that signifies to an apparatus connected through the mating connector to the output connector that the output connector 222 is to be identified as a power supply or battery charger. For example, shorting or connecting together the first data line 214 and the second data line 216 (which would result in a zero or negligible resistance value between the lines) is a common technique to indicate that a device with a USB socket is a power supply or battery charger, and is not suing the USB connection for data communications.

Figure 3:
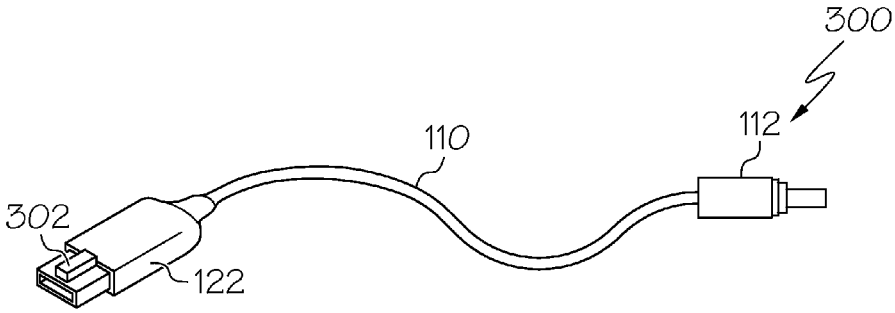
FIG. 3 illustrates a keyed output power cable, according to one example.

FIG. 3 illustrates a keyed output power cable 300, according to one example. The keyed output power cable 300 is an example of the output power cable 110, with mating connector 122 and device adapter 112, which is discussed above with regards to FIG. 1. The keyed output power cable 300 is able to be plugged into an output connector 120 and includes components whose values are determined by the adjustable output power supply 102 and that cause the adjustable output power supply 102 to provide output power with a programmable output voltage, a programmable electrical output current limit, or with a combination of a programmable output voltage and a programmable electrical output current limit, based on those determined values. The output power produced by the adjustable output power supply 102 is coupled to electrical power conductors within the output power cable 110 through connection pins within the mating connector 122. The electrical power conductors within the output power cable 110 are further connected to the device adapter 112 to deliver electrical power to an electrical device 116 through a power input socket 118.

The mating connector 122 of the keyed output power cable 300 includes connections for data lines as is specified by the defined data connector specification to which the physical aspects of the mating connector 122 mostly complies. In one example, electrically resistive elements within the keyed output power cable 300 couple one or more of those data lines to one or more power lines that also couple through the mating connector 122.

The mating connector 122 of the keyed output power cable 300 includes a physical feature 302. The physical feature 302 in this example is a physical feature in the form of an appendage that extends outwardly from a surface of a part of the mating connector 122. In the illustrated example, the mating connector 122 has a physical form that complies with the physical form specified by the USB standard for the Standard A plug with the exception of the physical feature 302. The physical feature 302 in this example prevents the mating connector 122 from being able to be inserted into a corresponding connector that complies with the physical form defined by the USB standard for the Standard A receptacle.

In one example, a power supply that is able to accept the mating connector 122 senses the physical feature 302 and operates to determine one or more of an output voltage and an electrical output current limit as is described below. As described in further detail below, a mechanical switch within the output connector 120 is able to sense the presence of the physical feature 302 and control a process used to determine an output voltage and electrical current limit to be configured into the adjustable output power supply 102. In one example, the keyed output power cable 300 is able to include electrically resistive elements that couple data lines that couple through the mating connector 122 to one or more electrical power lines that are also coupled through the mating connector 122.

Figure 4:
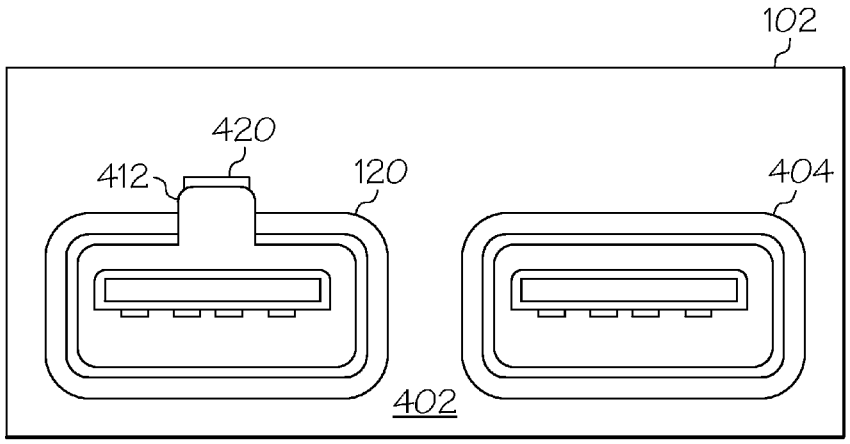
FIG. 4 illustrates an output connector panel, according to an example.

FIG. 4 illustrates an output connector panel 400, according to an example. The illustrated output connector panel 400 depicts a power supply side 402 that includes two output connectors, an output connector 120 and a second output connector 404. The power supply side 402 is one side of the adjustable output power supply 102 that is described above with regards to FIG. 1. In particular, the power supply side 402 is the side of the adjustable output power supply 102 onto which the output connector 120 is mounted.

The output connector 120 in the illustrated example partially complies with the physical specifications of the USB standard for a Type A socket. In this example, the Type A socket defined by the USB standard is a defined data interface standard connector. The output connector 120 in this example complies sufficiently with the physical specifications for a Type A socket defined by the USB standard so as to be able to accept a mating connector that fully complies with the USB standard for a Type A Plug, e.g., the output connector 120 is able to accept a conventional USB Type A plug.

The output connector 120 in this example differs from the physical specifications for the Type A socket defined by the USB standard by the presence of a feature keyway 412. The feature keyway 412 is an example of a feature recess configured to receive a physical feature of a mating connector. In the illustrated example, the feature keyway 412 is a recess above the socket of the output connector 120 that is able to accept the physical feature 302 of the mating connector 122 described above when the mating connector 122 is inserted into the output connector 120. The output connector 120 in this example includes a mechanical switch 420 that is pressed by the physical feature 302 when the mating connector 122 is inserted into the output connector 120.

In one example, the mechanical switch 420 sends a signal to a controller, as is discussed below, to indicate that a mating connector with a physical feature 302, such as the mating connector 122, is inserted into the output connector 120. In one example, an indication that a mating connector 122 with a physical feature 302 is inserted into the output connector 120 causes the controller to determine an output voltage and output electrical current limit with which to configure the adjustable output power supply 102.

In the illustrated example, a mating connector that conforms to the USB standard for Type A plugs is able to be inserted into the output connector 120. The mating connector that conforms to the USB standard for a Type A plug does not have the physical feature 302 and therefore does not activate the mechanical switch 420. In response to the mechanical switch not being activated, the power supply is configured as a conventional USB power supply with a five (5) volt output and a maximum electrical current limit of 500 mA.

The illustrated output connector panel 400 further includes a second output connector 404. The second output connector 404 in this example fully conforms to the USB standard for a Type A socket. It is to be noted that the second output connector 404 does not have a keyway recess and therefore a mating connector 122, which has a physical feature 302, is not able to be inserted into the second output connector 404. Due to the inability of the second output connector 404 to receive a mating connector 122, the second output connector 404 is configured to provide output electrical power with voltage and electrical current limits that are defined by the USB standard. In the illustrated example, the second output connector 404 is able to operate while the adjustable output power supply 102 is configured to produce output power through the output connector 120 with characteristics that are defined by either the USB standard or according to resistance measurements made by a controller, as is described in detail below.

Figure 5:
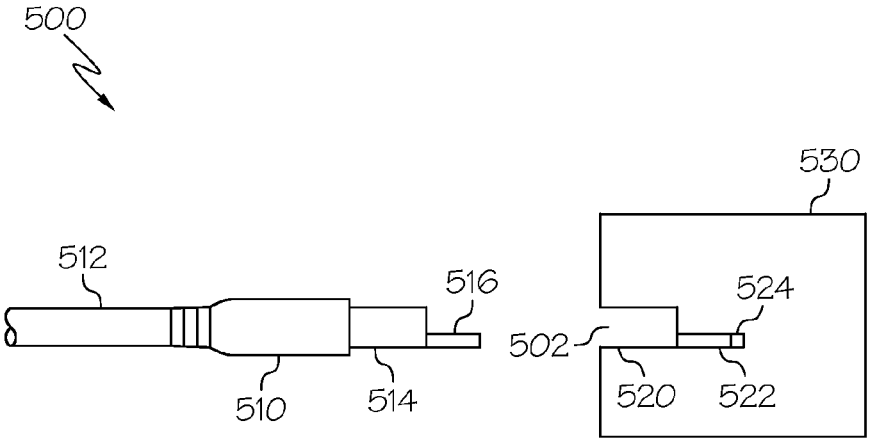
FIG. 5 illustrates a first physical feature connector coupling, according to an example.

FIG. 5 illustrates a first physical feature connector coupling 500, according to an example. The first physical feature connector coupling 500 depicts a first mating connector 510 which has a keyed plug 514. The keyed plug 514 in this example partially complies with the specifications of physical characteristics for a Type A plug as defined by the USB specification. The keyed plug 514 in this example has a physical feature key 516 that protrudes out of the front of the keyed plug 514. In this example, the physical feature key 516 is a not included in the physical characteristics for a Type A socket as defined by the USB specification. The first mating connector 510 in this example has power and data conductors that enter from a multiple conductor cable 512 and couple through the keyed plug 514 to a corresponding connector as described below.

The first physical feature connector coupling 500 further includes a power supply 530 that has a first output connector 502. The first output connector 502 of one example partially complies with the physical characteristics for a Type A socket as defined by the USB specification. The first output connector 502 includes a connector socket cavity 520 that complies with the physical characteristics for the cavity of a Type A socket as defined by the USB specification. A conventional USB Type A plug is able to be inserted into the first output connector 502 of the power supply 530. The power supply 530 is configured to provide electrical power that conforms to the electrical output power defined by the USB standard through power conductors of the first output connector 502 when a conventional USB Type A plug is inserted.

In addition to the physical characteristics defined for a Type A socket, the first output connector 502 further includes a keyway recess 522 into which the physical feature key 516 of the first mating connector 510 is inserted when the first mating connector 510 is inserted into the first output connector 502. The keyway recess 522 has a switch 524 at its innermost end that detects the presence of the physical feature key 516. With reference to the description of FIG. 2, above, the switch 524 is an example of feature sensor 230. In response to the insertion of a first mating connector 510 with a physical feature key 516, the physical feature key 516 presses the switch 524 and either open or closes a contact within the switch 524. This change in switch contact state changes a signal level provided to a controller in the power supply 530, which responds as described above with regards to FIG. 2.

Figure 6:
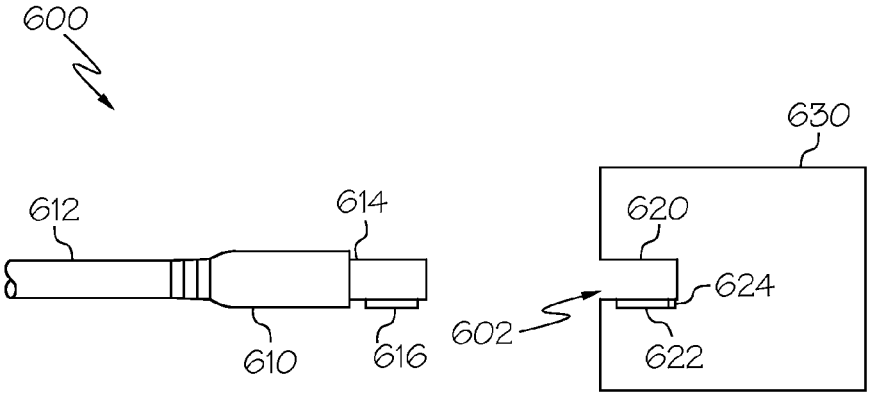
FIG. 6 illustrates a second physical feature connector coupling, according to an example.

FIG. 6 illustrates a second physical feature connector coupling 600, according to an example. The second physical feature connector coupling 600 depicts a second mating connector 610 which has a keyed plug 614. The keyed plug 614 in this example partially complies with the specifications of physical characteristics for a Type A plug as defined by the USB specification. The keyed plug 614 in this example has a physical feature key 616 that protrudes from the top of the keyed plug 614. In this example, the physical feature key 616 is a not included in the physical characteristics for a Type A socket as defined by the USB specification. The second mating connector 610 in this example has power and data conductors that enter from a multiple conductor cable 612 and couple through the keyed plug 614 to a corresponding connector as described below.

The second physical feature connector coupling 600 further includes a power supply 630 that has a second output connector 602. The second output connector 602 of one example partially complies with the physical characteristics for a Type A socket as defined by the USB specification. The second output connector 602 includes a connector socket cavity 620 that complies with the physical characteristics for the cavity of a Type A socket as defined by the USB specification. A conventional USB Type A plug is able to be inserted into the second output connector 602 and the power supply 630. The power supply 630 is configured to provide electrical power that conforms to the electrical output power defined by the USB standard through power conductors of the second output connector 602 when a conventional USB Type A plug is inserted.

In addition to the physical characteristics defined for a Type A socket, the second output connector 602 further includes a keyway recess 622 into which the physical feature key 616 of the second mating connector 610 is inserted when the second mating connector 610 is inserted into the second output connector 602. The keyway recess 622 has a switch 624 at its innermost end that detects the presence of the physical feature key 616. With reference to the description of FIG. 2, above, the switch 624 is an example of feature sensor 230. In response to the insertion of a second mating connector 610 with a physical feature key 616, the physical feature key 616 presses the switch 624 and either open or closes a contact within the switch 624. This change in switch contact state changes a signal level provided to a controller in the power supply 630, which responds as described above with regards to FIG. 2.

Figure 7:
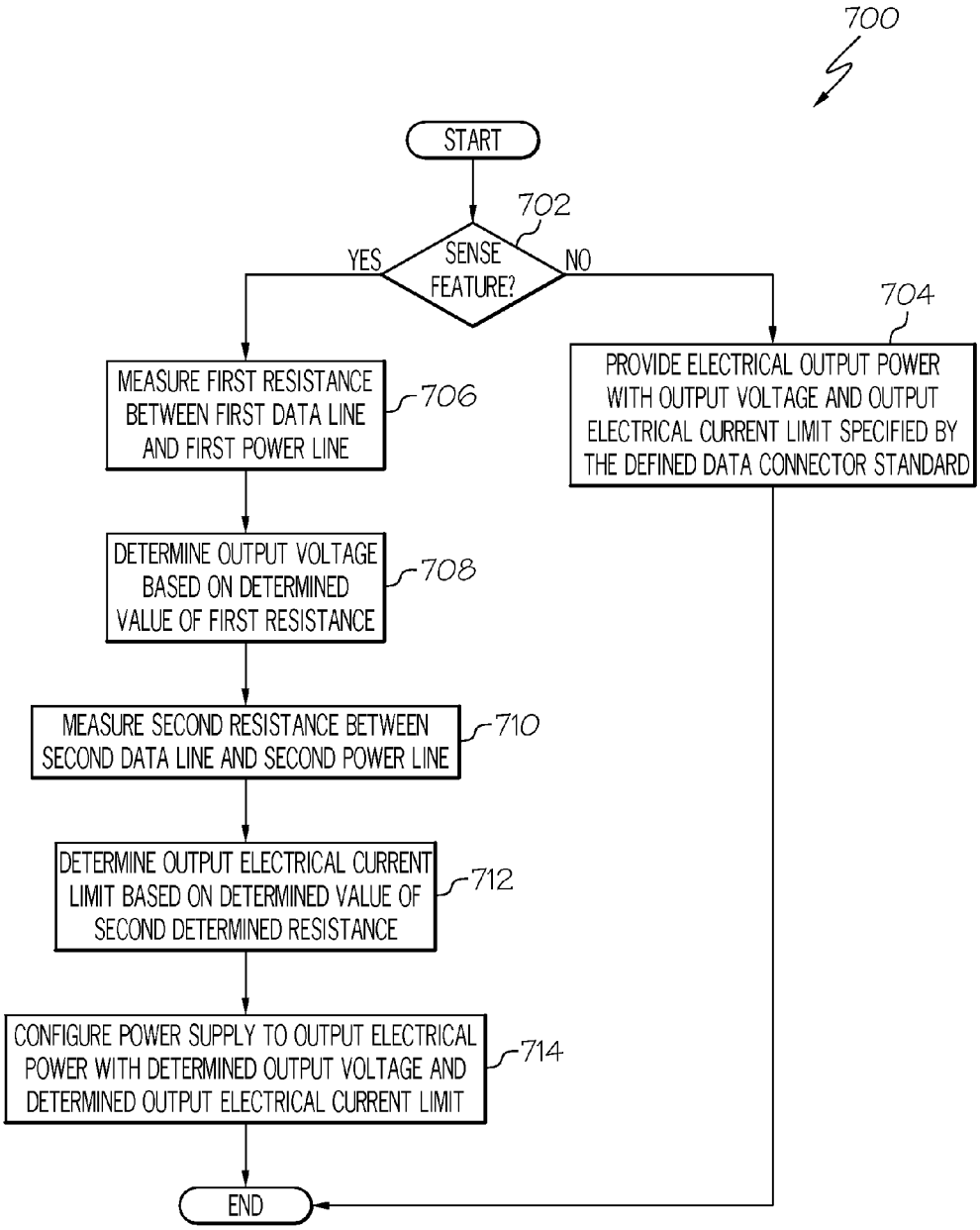
FIG. 7 illustrates a power requirement determination process, according to an example.

FIG. 7 illustrates a power requirement determination process 700, according to an example. The following description of the power requirement determination process 700 refers to elements of the power supply circuit diagram 200 described above with regards to FIG. 2. The power requirement determination process 700 is an example of a process performed by the controller 202 depicted in the power supply circuit diagram 200 to determine the values of resistors between data lines and power lines connected through the output connector 222 and to determine, based on those resistance values, the value of output voltage and output electrical current limit that are to be configured in the programmable power supply 220.

The power requirement determination process 700 begins by determining, at 702, if a feature is sensed. As described above, a feature is a characteristic of a mating connector 122 that is inserted into an output connector 120 as described above with regards to FIG. 1. The feature sensor 230 in the illustrated example performs this sensing, which is able to be either a mechanical or optical sensing of a physical feature of the mating connector, a magnetic sensing of a magnet within the mating connector, any sensing of a feature, or combinations of these.

If a feature is not sensed, the power requirement determination process 700 proceeds to provide, at 704, electrical output power with an output voltage and an output electrical current limit specified by the defined data connector standard to which the output connector partially complies. As discussed above, the output connector 222 partially complies with the physical specifications for the Type A socket connector defined by the USB standard. Such a socket is specified by the USB standard to provide electrical power at five (5) volts with an output electrical current limit of 500 mA. The power requirement determination process 700 then ends.

If a feature is sensed, at 702, the power requirement determination process 700 proceeds to measure, at 706, a first resistance between a first data line and a first power line that are coupled to respective contacts in a mating connector through the output connector 222. In this example, the first data line is electrically connected to a first data connector and the first power line is electrically connected to a first electrical power contact. As described above, the first resistance is able to be measured by any suitable technique, such as by an ohmmeter and suitable switches as described above. An output voltage is then determined, at 708, based on the determined value of the first resistance. As discussed above, the output voltage is able to be determined based upon any suitable technique, such as by a lookup table.

A second resistance between a second data line and a second power line that are coupled to a mating connector through the output connector 222 is measured, at 710. In this example, the second data line is electrically connected to a second data connector and the second power line is electrically connected to a second electrical power contact. This measurement is similar to the above described measurement of the first resistance. An output electrical current limit is then determined, at 712, based on the determined value of the second resistance. The output electrical current limit is also able to be determined by based upon any suitable technique, such as by a lookup table.

The power requirement determination process 700 proceeds by configuring, at 714, the power supply to output electrical power with the determined output voltage and determined output electrical current limit. The power requirement determination process 700 then ends.

Figure 8:
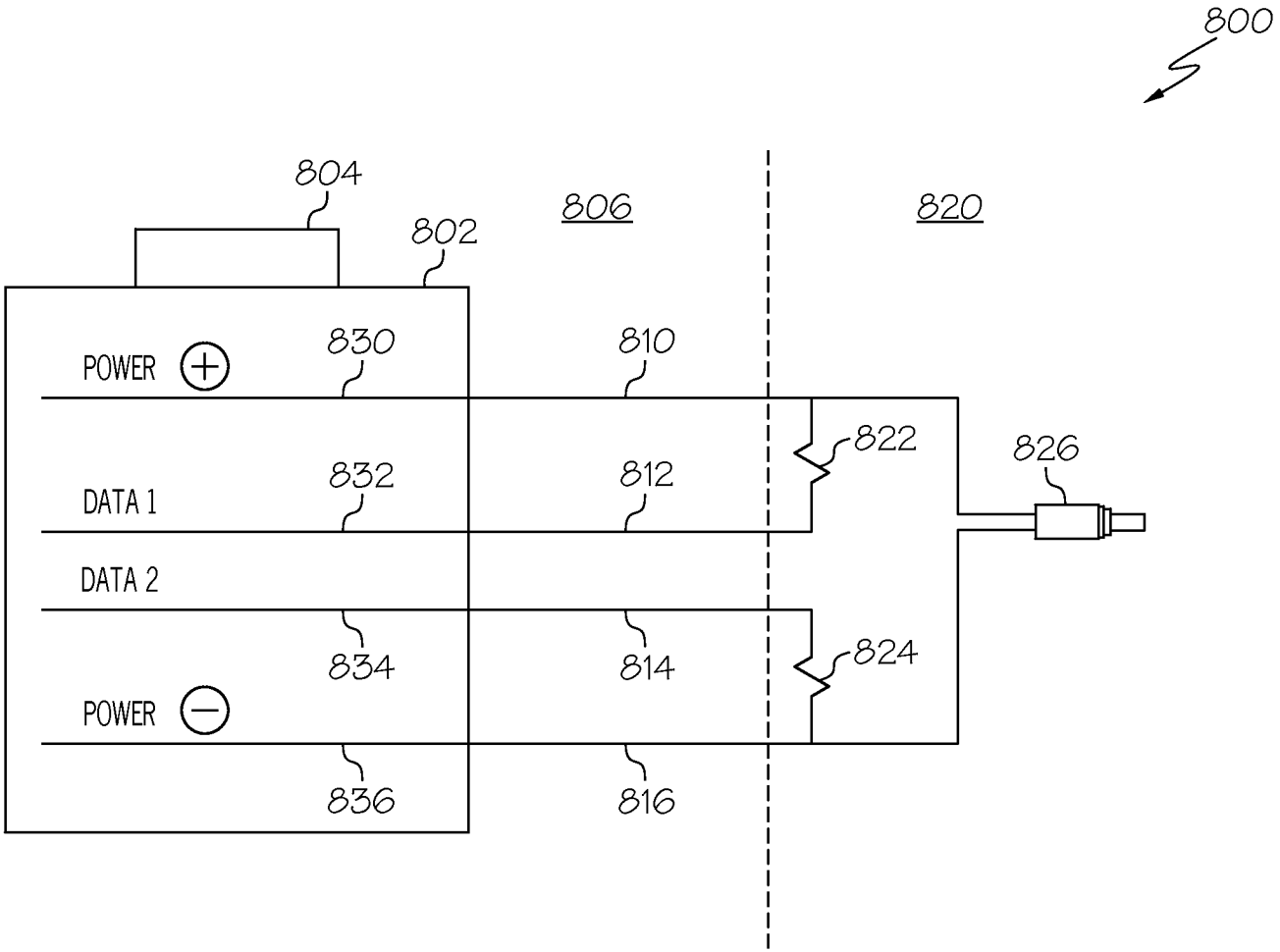
FIG. 8 illustrates a keyed output power cable connection diagram, according to an example.

FIG. 8 illustrates a keyed output power cable connection diagram 800, according to an example. The keyed output power cable connection diagram 800 illustrates a mating connector 802 that has a physical feature 804, as is described above with regards to FIG. 3. The mating connector 802 is further shown be connected to a multiple conductor cable 806, which has four (4) conductors in this example. Each conductor in the multiple conductor cable 806 is electrically coupled to a contact in the mating connector 802.

The mating connector 802 has a Power (+) contact 830 that is electrically coupled to a positive power line 810 of the multiple conductor cable 806. The mating connector 802 also has a Power (−) contact 836 that is electrically coupled to a negative power line 816 of the multiple conductor cable 806. The mating connector 802 further includes a Data 1 contact 832 and a Data 2 contact 834 that are electrically coupled to a first data line 812 and a second data line 814 of the multiple conductor cable 806, respectively.

The first data line 812 is electrically coupled to the positive power line 810 through a first resistor 822. The second data line 814 is electrically coupled to the negative power line 816 through a second resistor 824. As discussed above, a power supply to which the mating connector 802 is inserted is able to detect the physical feature 804 and operate to determine the values of the first resistor 822 and the second resistor 824 and the output voltage and output electrical current limit is set according to the values of these two resistors.

The keyed output power cable connection diagram 800 further shows a device connector 820 coupled to the end of the multiple conductor cable 806 that is opposite the mating connector 802. The device connector couples the positive power line 810 and the negative power line 816 to a device plug 826. The device plug 826 is configured to be received into a power socket of, for example, an electronic device that is to receive electrical power from a power supply through the keyed output power cable depicted in the keyed output power cable connection diagram 800.

The illustrated keyed output power cable connection diagram 800 depicts the first resistor 822 and the second resistor 824 being within the device connector 820. In some examples, the device connector is detachable from the multiple conductor cable 806 and is able to be replaced with another device connector that matches the power socket of a different electronic device. In one example, a number of detachable device connectors where each is similar to the device connector 820, is able to be manufactured where each detachable device connector is associated with a particular electronic device model or range of models. The same power supply is then able to be used with the multiple conductor cable 806 to provide power to a large range of electronic devices by only changing the device connector 820 for each electronic device. Including the first resistor 822 and the second resistor 824 in the device connector 820 allows the output voltage and output electrical current limit to be set to values that correspond to different electronic devices that are associated with a particular device connector 820. In a further example, the first resistor 822 and the second resistor 824 are able to be included in the multiple conductor cable 806 or within the mating connector 802. In yet a further example, the multiple conductor cable 806 is able to have a device connector that also couples the first data line 812 and the second data line 814 into the electronic device, and the first resistor 822 and the second resistor 824 are able to be included in that electronic device.

Figure 9:
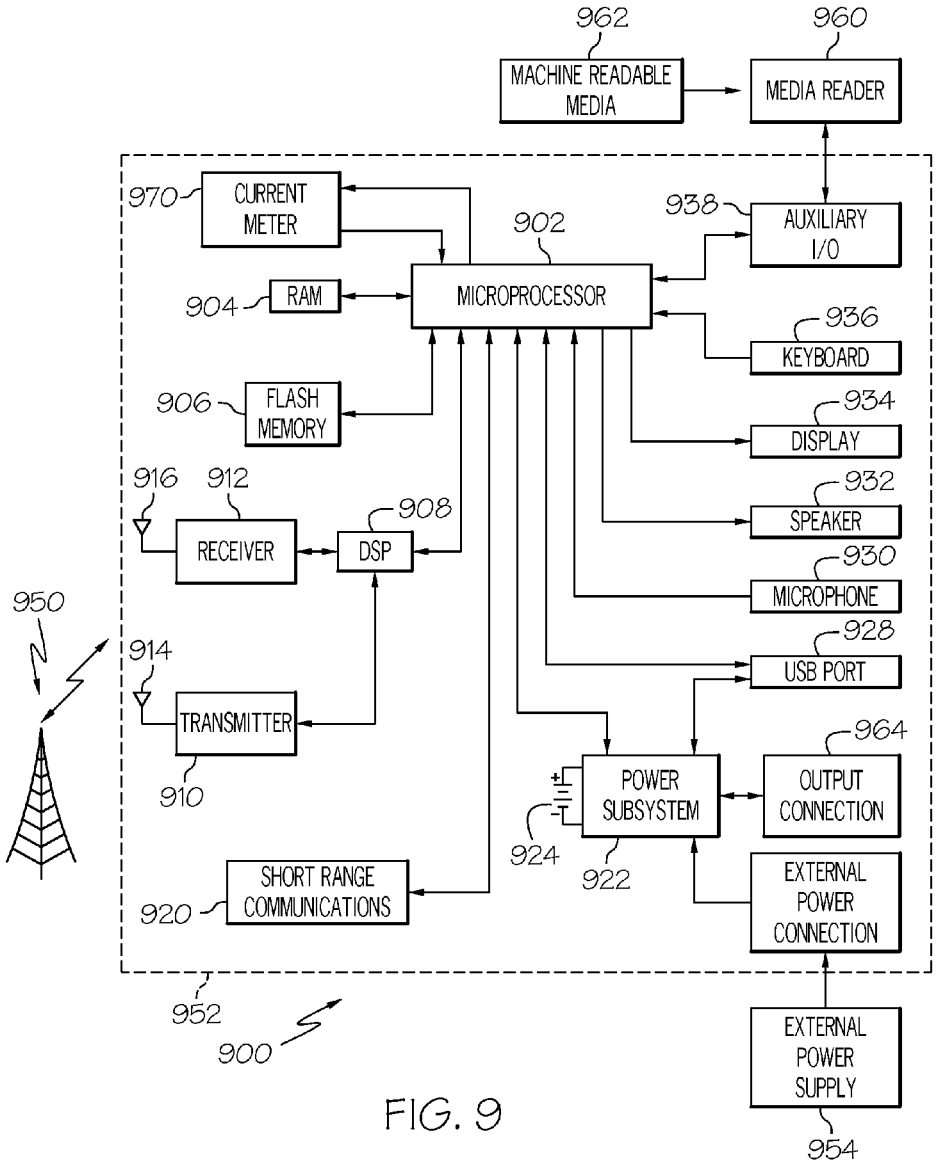
FIG. 9 is a block diagram of an electronic device and associated components 900 that are able to be used in conjunction with the systems and methods disclosed herein.

FIG. 9 is a block diagram of an electronic device and associated components 900 that are able to be used in conjunction with the systems and methods disclosed herein. The electronic device 952 in one example is able to also operate as an adjustable output power supply, such as the adjustable output power supply 102 discussed above, to provide electrical power to other electrical devices through an output connector. The electronic device 952 is alternatively able to operate as an electrical device, such as the above described electrical device 116, that receives electrical power from an adjustable output power supply, such as the above described adjustable output power supply 102. The electronic device 952 is also able to operate as both an adjustable output power supply that produces output electrical power at various output voltages and output electrical current limits, and also as an electrical device that receives such output electrical power.

The electronic device 952 depicted in this example includes circuitry and processing capabilities to support operation as a wireless two-way communication device with voice and data communication capabilities. Such electronic devices communicate with a wireless voice or data network 950 using a suitable wireless communications protocol. Wireless voice communications are performed using either an analog or digital wireless communication channel. Data communications allow the electronic device 952 to communicate with other computer systems via the Internet. Examples of electronic devices that are able to incorporate the above described systems and methods include, for example, a data messaging device, a two-way pager, a cellular telephone with data messaging capabilities, a wireless Internet appliance or a data communication device that may or may not include telephony capabilities.

The illustrated electronic device 952 is an example electronic device that includes two-way wireless communications functions. Such electronic devices incorporate communication subsystem elements such as a wireless transmitter 910, a wireless receiver 912, and associated components such as one or more antenna elements 914 and 916. A digital signal processor (DSP) 908 performs processing to extract data from received wireless signals and to generate signals to be transmitted. The particular design of the communication subsystem is dependent upon the communication network and associated wireless communications protocols with which the device is intended to operate.

The electronic device 952 includes a microprocessor 902 that controls the overall operation of the electronic device 952. The microprocessor 902 interacts with the above described communications subsystem elements and also interacts with other device subsystems such as flash memory 906, random access memory (RAM) 904, auxiliary input/output (I/O) device 938, data port 928 (such as a USB port), display 934, keyboard 936, speaker 932, microphone 930, a short-range communications subsystem 920, a power subsystem 922, a current meter 970, other subsystems, or combinations of these.

One or more power storage or supply elements, such as a battery 924, are connected to a power subsystem 922 to provide power to the circuits of the electronic device 952. The power subsystem 922 includes power distribution circuitry for providing power to the electronic device 952 and also contains battery charging circuitry to manage recharging the battery 924 (or circuitry to replenish power to another power storage element).

The power subsystem 922 is able to receive electrical power from external power supply 954. The power subsystem 922 includes a battery monitoring circuit that is operable to provide a status of one or more battery status indicators, such as remaining capacity, temperature, voltage, electrical current consumption, and the like, to various components of the electronic device 952.

The power subsystem 922 is able to be connected to the external power supply 954 through a dedicated external power connector 926 or through power connections within the USB port 928. The external power connector 926 in one example is similar to the power input socket 118 of the electrical device 116 that is described above with regards to FIG. 1. The power subsystem 922 in one example is able to operate as an adjustable output power supply, such as the adjustable output power supply 102 described above with regards to FIG. 1. The power subsystem 922 in one example is able to provide output electrical power to external devices through the output connector 964. The output connector 964 in one example is similar to the above described output connector 120 discussed above with regards to FIG. 1 and the output connector 222 described above with regards to FIG. 2. The output connector 964 of one example at least partially conforms to the physical specifications of a defined data interface standard connector, such as the physical specifications of a Type A USB socket. The output connector 964 is further configured to receive a feature on a connector that is an indication that the power subsystem 922 is to determine an output voltage and output electrical current limit value according to the above described techniques.

Data communication through data port 928 enables a user to set preferences through the external device or through a software application and extends the capabilities of the device by enabling information or software exchange through direct connections between the electronic device 952 and external data sources rather than via a wireless data communication network. In addition to data communication, the data port 928 provides power to the power subsystem 922 to charge the battery 924 or to supply power to the electronic circuits, such as microprocessor 902, of the electronic device 952.

Operating system software used by the microprocessor 902 is stored in flash memory 906. Further examples are able to use a battery backed-up RAM or other non-volatile storage data elements to store operating systems, other executable programs, or both. The operating system software, device application software, or parts thereof, are able to be temporarily loaded into volatile data storage such as RAM 904. Data received via wireless communication signals or through wired communications are also able to be stored to RAM 904.

The microprocessor 902, in addition to its operating system functions, is able to execute software applications on the electronic device 952. A set of applications that control basic device operations, including at least data and voice communication applications, is able to be installed on the electronic device 952 during manufacture. Examples of applications that are able to be loaded onto the device may be a personal information manager (PIM) application having the ability to organize and manage data items relating to the device user, such as, but not limited to, e-mail, calendar events, voice mails, appointments, and task items. The microprocessor 902 is further able to perform part or all of the above described processing.

Further applications may also be loaded onto the electronic device 952 through, for example, the wireless network 950, an auxiliary I/O device 938, Data port 928, short-range communications subsystem 920, or any combination of these interfaces. Such applications are then able to be installed by a user in the RAM 904 or a non-volatile store for execution by the microprocessor 902.

In a data communication mode, a received signal such as a text message or web page download is processed by the communication subsystem, including wireless receiver 912 and wireless transmitter 910, and communicated data is provided the microprocessor 902, which is able to further process the received data for output to the display 934, or alternatively, to an auxiliary I/O device 938 or the Data port 928. A user of the electronic device 952 may also compose data items, such as e-mail messages, using the keyboard 936, which is able to include a complete alphanumeric keyboard or a telephone-type keypad, in conjunction with the display 934 and possibly an auxiliary I/O device 938. Such composed items are then able to be transmitted over a communication network through the communication subsystem.

For voice communications, overall operation of the electronic device 952 is substantially similar, except that received signals are generally provided to a speaker 932 and signals for transmission are generally produced by a microphone 930. Alternative voice or audio I/O subsystems, such as a voice message recording subsystem, may also be implemented on the electronic device 952. Although voice or audio signal output is generally accomplished primarily through the speaker 932, the display 934 may also be used to provide an indication of the identity of a calling party, the duration of a voice call, or other voice call related information, for example.

Depending on conditions or statuses of the electronic device 952, one or more particular functions associated with a subsystem circuit may be disabled, or an entire subsystem circuit may be disabled. For example, if the battery temperature is low, then voice functions may be disabled, but data communications, such as e-mail, may still be enabled over the communication subsystem.

A short-range communications subsystem 920 in one example is a short range wireless data communications component that provides data communication between the electronic device 952 and different systems or devices, which need not necessarily be similar devices. For example, the short-range communications subsystem 920 includes an infrared device and associated circuits and components or a Radio Frequency based communication module such as one supporting Bluetooth® communications, to provide for communication with similarly-enabled systems and devices, including the data file transfer communications described above.

A media reader 960 is able to be connected to an auxiliary I/O device 938 to allow, for example, loading computer readable program code of a computer program product into the electronic device 952 for storage into flash memory 906. One example of a media reader 960 is an optical drive such as a CD/DVD drive, which may be used to store data to and read data from a computer readable medium or storage product such as computer readable storage media 962. Examples of suitable computer readable storage media include optical storage media such as a CD or DVD, magnetic media, or any other suitable data storage device. Media reader 960 is alternatively able to be connected to the electronic device through the Data port 928 or computer readable program code is alternatively able to be provided to the electronic device 952 through the wireless network 950.

Information Processing System

The present subject matter can be realized in hardware, software, or a combination of hardware and software. A system can be realized in a centralized fashion in one computer system, or in a distributed fashion where different elements are spread across several interconnected computer systems. Any kind of computer system—or other apparatus adapted for carrying out the methods described herein—is suitable. A typical combination of hardware and software could be a general purpose computer system with a computer program that, when being loaded and executed, controls the computer system such that it carries out the methods described herein.

The present subject matter can also be embedded in a computer program product, which comprises all the features enabling the implementation of the methods described herein, and which—when loaded in a computer system—is able to carry out these methods. Computer program in the present context means any expression, in any language, code or notation, of a set of instructions intended to cause a system having an information processing capability to perform a particular function either directly or after either or both of the following a) conversion to another language, code or, notation; and b) reproduction in a different material form.

Each computer system may include, inter alia, one or more computers and at least a computer readable medium allowing a computer to read data, instructions, messages or message packets, and other computer readable information from the computer readable medium. The computer readable medium may include computer readable storage medium embodying non-volatile memory, such as read-only memory (ROM), flash memory, disk drive memory, CD-ROM, and other permanent storage. Additionally, a computer medium may include volatile storage such as RAM, buffers, cache memory, and network circuits. Furthermore, the computer readable medium may comprise computer readable information in a transitory state medium such as a network link and/or a network interface, including a wired network or a wireless network, that allow a computer to read such computer readable information.

Non-Limiting Examples

Although specific embodiments of the subject matter have been disclosed, those having ordinary skill in the art will understand that changes can be made to the specific embodiments without departing from the spirit and scope of the disclosed subject matter. The scope of the disclosure is not to be restricted, therefore, to the specific embodiments, and it is intended that the appended claims cover any and all such applications, modifications, and embodiments within the scope of the present disclosure.

One or more embodiments may realize one or more benefits, some of which (such as improved efficiency) have been mentioned already. One or more embodiments may be adapted for use with a number of wirelessly powered devices. Some embodiments may be implemented in relatively small space, making them useful for wirelessly powering handheld devices or transferring power to wirelessly powered devices on the limited space of a table or desk. The techniques enable a user, quickly and conveniently, and perhaps intuitively, to use the feedback of the indications to improve the powering or charging of the user's device. By observing the indicators, a user can improve the strength of the inductive coupling, and may thereby achieve one or more desirable results, such as reducing the time for inductive charging of the device.

What is claimed is:

1. An adjustable output power supply, comprising:

a data communications connector at least partially complying with physical specifications of a defined data interface standard connector, the data communications connector comprising:

a plurality of data contacts, wherein the data contacts are specified for the defined data interface standard connector to convey data; and a plurality of electrical power contacts specified for the defined data interface standard connector to convey electrical power, wherein the plurality of electrical power contacts is coupled to and is providing output electrical power from a programmable power supply; and a controller, communicatively coupled to the programmable power supply, the controller configured to:

receive an indication of a detection of a physical feature of a mating connector coupled to the data communications connector, wherein the mating connector differs, by the presence of the physical feature, from physical specifications for a complementary connector for the defined data interface standard connector; and determine, based on receiving the indication, at least one resistance value between at least one data contact within the plurality of data contacts and at least one electrical power contact within the plurality of electrical power contacts, and adjust an output voltage of the programmable power supply based on the at least one resistance value.

2. The power supply of claim 1, further comprising a feature sensor located in proximity to the data communications connector and communicatively coupled to the controller, the feature sensor configured to detect a presence of the physical feature of the mating connector when the mating connector is coupled to the data communications connector, wherein the feature sensor provides, based on the detection of the presence of the physical feature, the indication.

3. The power supply of claim 1, wherein the controller is further configured to disable data communications over the plurality of data contacts based upon receiving the indication of the detection of the physical feature.

4. The power supply of claim 1, wherein the controller is configured to adjust, in response to an absence of the indication, the output voltage of the programmable power supply to an output power voltage specified for the defined data interface standard connector.

5. The power supply of claim 4, wherein the defined data interface standard connector comprises a Universal Serial Bus connector, and wherein the controller is configured to adjust, in response to the absence of the indication, the output voltage of the programmable power supply to five volts.

6. The power supply of claim 1, wherein the programmable power supply is further configured to provide output electrical power with a limited output electrical current, and wherein the controller is further configured to:

determine, based on receiving the indication, a second resistance value between at least one second data contact within the plurality of data contacts and at least one second electrical power contact within the plurality of electrical power contacts, wherein the second resistance value is different from the at least one resistance value; and adjust an output electrical current limit value of the programmable power supply based upon the second resistance value.

7. The power supply of claim 6, wherein the controller is configured to determine the at least one resistance value by at least determining a first resistance between a first electrical power contact within the plurality of electrical power contacts and a first data contact within the plurality of data contacts, wherein at least one of the first data contact differs from the second data contact and the first electrical power contact differs from the second electrical power contact.

8. A method of operating a power supply, the method comprising:

receiving an indication of a detection of a physical feature of a mating connector coupled to a data communications connector, wherein the data communications connector at least partially complies with physical specifications of a defined data interface standard connector, wherein the mating connector differs, by the presence of the physical feature, from physical specifications for a complementary connector for the defined data interface standard connector, the data communications connector comprising:

a plurality of data contacts, wherein the data contacts are specified for the defined data interface standard connector to convey data; and a plurality of electrical power contacts specified for the defined data interface standard connector to convey electrical power, wherein the plurality of electrical power contacts provide output electrical power from a programmable power supply;

determining, based on receiving the indication, at least one resistance value between at least one data contact within the plurality of data contacts and at least one electrical power contact within the plurality of electrical power contacts; and adjusting an output voltage of the programmable power supply based on the at least one resistance value.

9. The method of claim 8, further comprising:

detecting a presence of the physical feature of the mating connector when the mating connector is coupled to the data communications connector; and providing, based on detecting the presence of the physical feature, the indication.

10. The method of claim 8, further comprising disabling data communications over the plurality of data contacts based upon receiving the indication.

11. The method of claim 8, further comprising adjusting, in response to an absence of the indication, the output voltage of the programmable power supply to an output power voltage specified for the defined data interface standard connector.

12. The method of claim 11, wherein the defined data interface standard connector comprises a Universal Serial Bus connector, and wherein the adjusting, in response to the absence of the indication, comprises adjusting the output voltage of the programmable power supply to five volts.

13. The method of claim 8 further comprising:

determining, based on receiving the indication, a second resistance value between at least one second data contact within the plurality of data contacts and at least one second electrical power contact within the plurality of electrical power contacts, wherein the second resistance value is different from the at least one resistance value; and adjusting an output electrical current limit value of the programmable power supply based upon the second resistance value.

14. The method of claim 13, wherein the determining the at least one resistance value comprises determining a first resistance between a first electrical power contact within the plurality of electrical power contacts and a first data contact within the plurality of data contacts, wherein at least one of the first data contact differs from the second data contact and the first electrical power contact differs from the second electrical power contact.

15. A non-transitory computer readable storage medium having computer readable program code embodied therewith, the computer readable program code comprising instructions for:

receiving an indication of a detection of a physical feature of a mating connector coupled to a data communications connector, wherein the data communications connector at least partially complies with physical specifications of a defined data interface standard connector, wherein the mating connector differs, by the presence of the physical feature, from physical specifications for a complementary connector for the defined data interface standard connector, the data communications connector comprising:

a plurality of data contacts, wherein the data contacts are specified for the defined data interface standard connector to convey data; and a plurality of electrical power contacts specified for the defined data interface standard connector to convey electrical power, wherein the plurality of electrical power contacts provide output electrical power from a programmable power supply;

determining, based on receiving the indication, at least one resistance value between at least one data contact within the plurality of data contacts and at least one electrical power contact within the plurality of electrical power contacts; and adjusting an output voltage of the programmable power supply based on the at least one resistance value.

16. The non-transitory computer readable storage medium of claim 15, the computer readable program code further comprising instructions for:

detecting a presence of the physical feature of the mating connector when the mating connector is coupled to the data communications connector; and providing, based on detecting the presence of the physical feature, the indication.

17. The non-transitory computer readable storage medium of claim 15, the computer readable program code further comprising instructions for disabling data communications over the plurality of data contacts based upon receiving the indication.

18. The non-transitory computer readable storage medium of claim 15, the computer readable program code further comprising instructions for adjusting, in response to an absence of the indication, the output voltage of the programmable power supply to an output power voltage specified for the defined data interface standard connector.

19. The non-transitory computer readable storage medium of claim 15, the computer readable program code further comprising instructions for:

determining, based on receiving the indication, a second resistance value between at least one second data contact within the plurality of data contacts and at least one second electrical power contact within the plurality of electrical power contacts, wherein the second resistance value is different from the at least one resistance value; and adjusting an output electrical current limit value of the programmable power supply based upon the second resistance value.

20. The non-transitory computer readable storage medium of claim 19, wherein the instructions for determining the at least one resistance value comprise instructions for determining a first resistance between a first electrical power contact within the plurality of electrical power contacts and a first data contact within the plurality of data contacts, wherein at least one of the first data contact differs from the second data contact and the first electrical power contact differs from the second electrical power contact.

* * * * *